US008333288B2

(12) United States Patent
Miller et al.

(10) Patent No.: US 8,333,288 B2
(45) Date of Patent: Dec. 18, 2012

(54) CHILD RESISTANT CONTAINER HAVING CAP AND LOCKING RING

(75) Inventors: Paul Miller, Cheraw, SC (US); Michael T Drummond, Laurinburg, NC (US); Robert Michael Schock, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 67 days.

(21) Appl. No.: 12/987,240

(22) Filed: Jan. 10, 2011

(65) Prior Publication Data

US 2012/0175336 A1 Jul. 12, 2012

(51) Int. Cl.
*B65D 55/02* (2006.01)

(52) U.S. Cl. ..... 215/216; 215/211; 215/213; 222/523

(58) Field of Classification Search ..... 215/211, 215/213, 216; 222/523
See application file for complete search history.

(56) References Cited

U.S. PATENT DOCUMENTS

| | | | | | |
|---|---|---|---|---|---|
| 809,213 | A | * | 1/1906 | Osgood | 215/251 |
| 3,175,853 | A | | 3/1965 | Gilbertson | |
| 3,199,704 | A | * | 8/1965 | Davidson | 215/334 |
| 3,231,156 | A | * | 1/1966 | Schultz | 222/92 |
| 3,696,955 | A | * | 10/1972 | Kundt et al. | 215/217 |
| 3,735,887 | A | * | 5/1973 | Morris | 215/221 |
| 3,843,006 | A | * | 10/1974 | Naito et al. | 215/220 |
| 3,863,798 | A | * | 2/1975 | Kurihara et al. | 215/301 |
| 3,968,894 | A | * | 7/1976 | Herrmann | 215/220 |
| 4,190,173 | A | * | 2/1980 | Mason et al. | 220/203.05 |
| 4,376,495 | A | * | 3/1983 | Spatz | 222/46 |
| 4,424,918 | A | * | 1/1984 | Stull | 222/153.14 |
| 4,498,609 | A | * | 2/1985 | Stock | 222/420 |
| 4,534,482 | A | * | 8/1985 | Bouche | 215/272 |
| 4,646,926 | A | | 3/1987 | Agbay et al. | |
| 4,768,682 | A | * | 9/1988 | Friedrich | 222/153.09 |
| 4,773,572 | A | * | 9/1988 | Stull | 222/521 |
| 4,832,218 | A | * | 5/1989 | Gibilisco | 215/220 |
| 4,921,366 | A | * | 5/1990 | Hurrell | 401/126 |
| 4,941,598 | A | * | 7/1990 | Lambelet et al. | 222/321.6 |
| 4,979,648 | A | * | 12/1990 | Montgomery et al. | 222/153.14 |
| 5,114,029 | A | * | 5/1992 | Gibilisco | 215/220 |
| 5,213,223 | A | | 5/1993 | Minnette | |
| 5,246,145 | A | * | 9/1993 | Leoncavallo et al. | 222/153.14 |
| 5,303,835 | A | * | 4/1994 | Haber et al. | 215/247 |
| 5,388,727 | A | * | 2/1995 | Jouillat | 222/94 |
| 5,501,370 | A | * | 3/1996 | Okamura et al. | 222/111 |
| 5,505,342 | A | * | 4/1996 | Okamura et al. | 222/212 |

(Continued)

FOREIGN PATENT DOCUMENTS

WO 2005/021398 A2 3/2005

*Primary Examiner* — Anthony Stashick
*Assistant Examiner* — Ned A Walker
(74) *Attorney, Agent, or Firm* — Miller Matthias & Hull LLP

(57) ABSTRACT

A child proof or child resistant container made primarily from fiber based materials is provided. The container comprises a tubular body, a cap that slides onto the body and a separate locking ring that fits within the cap. The locking ring is provided with diametrically opposed squeeze tabs that extend through openings in the cap and locking detents that fit into openings in the container body wall to lock the cap onto the body. The container body and cap may both be made from fiber based materials such as paper and the locking ring may be made from plastic. To open the container the user simultaneously squeezes the squeeze tabs while lifting and rotating the cap.

7 Claims, 4 Drawing Sheets

U.S. PATENT DOCUMENTS 5,560,505 A * 10/1996 Schneider et al. ..... 215/330
5,735,417 A 4/1998 Darr et al.
5,749,496 A 5/1998 DeJonge, Sr. et al.
5,799,829 A * 9/1998 Lier et al. ..... 222/83
5,819,968 A * 10/1998 Jones ..... 215/222
5,871,128 A * 2/1999 Carroll ..... 222/568
5,876,137 A * 3/1999 Byrd ..... 401/78
5,934,457 A * 8/1999 Ueda et al. ..... 206/204
6,036,036 A * 3/2000 Bilani et al. ..... 215/216
6,065,648 A * 5/2000 Tauber ..... 222/153.14
6,135,329 A * 10/2000 Stoneberg et al. ..... 222/521
6,149,022 A * 11/2000 Akyildiz et al. ..... 215/222
6,202,876 B1 * 3/2001 DeJonge ..... 220/217
6,290,108 B1 * 9/2001 Gross ..... 222/494
6,293,431 B1 * 9/2001 Seymour et al. ..... 222/83
6,299,038 B1 * 10/2001 Schmeisser et al. ..... 222/521
6,315,165 B1 * 11/2001 Regan ..... 222/103
6,378,713 B2 * 4/2002 Montgomery ..... 215/222
6,439,409 B1 8/2002 Dressel et al.
6,450,352 B1 * 9/2002 DeJonge ..... 215/217
7,004,340 B2 * 2/2006 Belden, Jr. ..... 215/215
7,100,783 B2 * 9/2006 Belden, Jr. ..... 215/215
7,100,784 B2 * 9/2006 Belden, Jr. ..... 215/215
7,111,746 B2 9/2006 Miceli et al.
7,168,435 B2 * 1/2007 Vieu et al. ..... 132/294
7,350,652 B2 * 4/2008 Belden, Jr. ..... 215/215
7,350,653 B2 * 4/2008 Belden, Jr. ..... 215/215
7,350,654 B2 * 4/2008 Belden, Jr. ..... 215/215
7,350,655 B2 * 4/2008 Belden, Jr. ..... 215/215
7,370,773 B2 5/2008 Toth et al.
7,435,027 B2 * 10/2008 Hetzel ..... 401/47
7,621,411 B2 * 11/2009 Doherty et al. ..... 215/228
7,635,071 B1 * 12/2009 Montgomery et al. ..... 222/546
7,637,375 B2 12/2009 Sattel et al.
7,648,051 B1 * 1/2010 Montgomery et al. .. 222/153.09
7,665,637 B2 * 2/2010 Foster ..... 222/521
7,677,413 B2 * 3/2010 Rahim et al. ..... 222/83
7,798,348 B2 9/2010 Sawyer
7,819,265 B2 10/2010 Brozell
2001/0019033 A1 * 9/2001 Montgomery ..... 215/332
2005/0072792 A1 * 4/2005 Harrold ..... 222/48
2005/0139621 A1 * 6/2005 Foster ..... 222/521
2006/0029459 A1 * 2/2006 Carroll ..... 401/206
2006/0278661 A1 * 12/2006 Cooper et al. ..... 222/321.1
2009/0067913 A1 * 3/2009 Vintimiglia ..... 401/129

* cited by examiner

CHILD RESISTANT CONTAINER HAVING CAP AND LOCKING RING

BACKGROUND OF THE INVENTION

1. Field of the Invention

This invention relates to a child resistant container. More particularly, this invention relates to a child resistant container that can be made primarily from paper.

2. Description of the Related Art

There are numerous references describing child proof or child resistant closures. The majority of these closures fall within one of three categories: bayonet (push and turn) type closures; closures that require the user to align elements to open; and closures that require the user to squeeze structural elements before removing a cap. The present invention falls within the last category.

Bayonet (Push and Turn) Type Closures

Bayonet type closures require the user to push down on the closure to release one or more inwardly projecting elements from slots located on the neck of the container, and then rotate the cap in one direction only.

U.S. Pat. No. 5,213,223 discloses a bayonet type closure comprising an adapter that threads on the threaded top of a bottle, and a cap that can be screwed onto the adapter. Co-acting resilient skirts bias the cap upward. To remove the cap, the user must push down on the cap and twist, thereby releasing cap projections from adapter ramp lugs.

U.S. Pat. No. 7,819,265 discloses a cap requiring a push and twist motion to remove. Pushing down on the cap allows inwardly extending lugs to clear notches in the bottle, while twisting the cap counterclockwise allows removal of the cap.

Align Elements to Remove Cap

Some child proof closures require the user to align elements (such as arrows) on the cap and container to allow a projection on one part to pass through a channel on the other part.

For example, U.S. Pat. No. 4,646,926 discloses a child proof cap that can be removed only after the user aligns a tab on a safety ring with a notch on the cap to allow inwardly projecting fingers on the safety ring to pass through release grooves on the cap. To remove the cap, the user pushes down on the safety ring. Once the safety ring has been slipped off the cap and the cap is no longer locked around the ring, the cap can be pulled or snapped off the container.

U.S. Pat. No. 7,111,746 discloses a bimodal (childproof and non-childproof) closure comprising an inner cap and outer cap. To remove the outer cap from the inner cap when in the childproof mode, the outer cap must be rotated until retaining tabs are aligned with channels. Pushing down on the outer cap will then disengage abutments in the outer cap from abutments in the inner cap, allowing the user to twist off the outer cap.

Squeeze Tabs and Lift Cap Type Closures

Another type of child proof container is one requiring the user to squeeze diametrically opposed tabs or other structural elements to disengage projections from recesses or other structural features.

U.S. Pat. No. 5,749,496 discloses a cap which can be opened by squeezing diametrically opposed areas of the cap, thereby allowing locking protrusions to surmount an annular bead located on the container body, then rotating the cap.

U.S. Pat. No. 6,439,409 discloses a child proof closure system comprising a cap and vial in which diametrically opposing latches on the cap are engaged by a peripheral ledge on the container. To open the vial the user pushes tabs on the cap which causes the latches on the cap to disengage from the peripheral ledge, allowing the cap to be removed.

U.S. Pat. No. 7,798,348 discloses a child resistant flip type cap in which outwardly biased retainer latches in the cap body engage retention lugs in the cap. To remove the cap a user must squeeze the latch-release pads on the body to disengage the latches, allowing the cap to flip open automatically.

While these and other references describe child proof containers that may be suitable for their particular purpose, there exists a need for a child proof container that can be made primarily of fiber based components.

Thus it is an object of the present invention to provide a child proof container in which the cap and container body can be made from fiber based materials such as spirally wound paper.

Another object of the present invention to provide a child proof container comprising a separate locking ring affixed to the inside of the cap, the locking ring having detents that engage openings in the container body.

Still another object of the invention is to provide a low cost, easily recyclable child proof container.

Further and additional objects will appear from the description, accompanying drawings, and appended claims.

BRIEF SUMMARY OF THE INVENTION

The present invention is a child proof or child resistant container that can be made primarily from easily recyclable fiber based materials, comprising a tubular body, a cap that slides onto the body without threads, and a separate locking ring that fits within the cap. To open the container the user must simultaneously squeeze diametrically opposed squeeze tabs while lifting up on the cap.

The tubular body may be cup-shaped and comprises a bottom wall, a side wall extending circumferentially upward from the bottom wall and terminating in a top rim, an open top end, and a pair of diametrically opposed openings located in the body side wall. The cap is also cup-shaped and comprises a top wall, a side wall extending circumferentially downward from the top wall and terminating in a bottom rim, an open bottom end configured to be slidably received over the tubular body, and a pair of diametrically opposed openings located in the cap side wall.

The locking ring comprises a resilient, semi-circular body, a pair of diametrically opposed squeeze tabs extending radially outward from the body and engageable with the openings in the cap, an arm extending axially downward from the semi-circular body below each squeeze tab and terminating in a lower end, and a locking detent extending radially outward from the lower end of each arm and engageable with the openings in the container body to prevent the easy removal of the cap from the body. The locking ring biases the squeeze tabs outward through the cap openings and the locking detents outward through the body openings.

To secure the cap to the body the user simultaneously squeezes the squeeze tabs while sliding the cap over the body until the lower rim of the locking ring abuts the top rim of the container body. At that point the locking detents are horizontally aligned with the openings in the container body. If necessary, the cap can be rotated until the locking detents are also vertically aligned with the body openings for engagement therewith to lock the cap onto the body.

To remove the cap the user squeezes the squeeze tabs, thereby disengaging the locking detents from the container body openings, while simultaneously lifting upward on and twisting the cap.

DETAILED DESCRIPTION OF THE INVENTION

Figure 1:
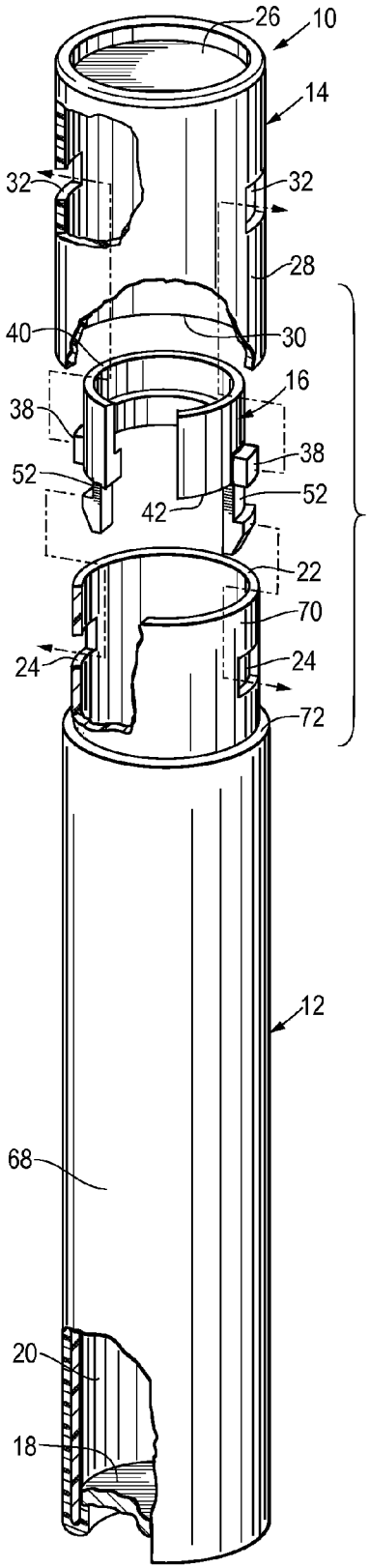
FIG. 1 is an exploded perspective view of the container of the present invention.
Figure 2A:
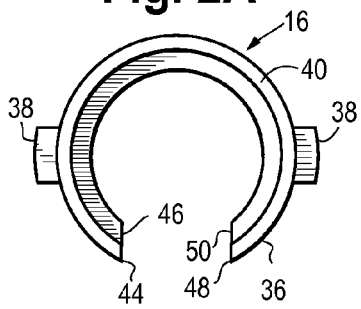
FIG. 2A is a top plan view of the locking ring component of the present invention.
Figure 2B:
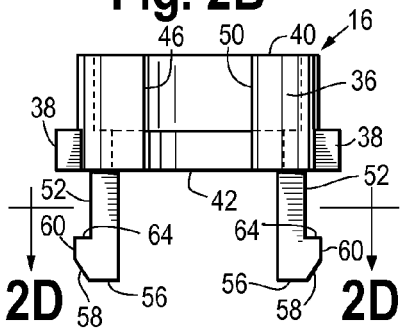
FIG. 2B is a front elevational view of the locking ring of FIG. 2A.
Figure 2C:
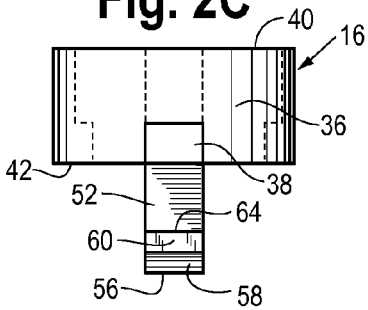
FIG. 2C is a side view of the locking ring of FIG. 2A.
Figure 2D:
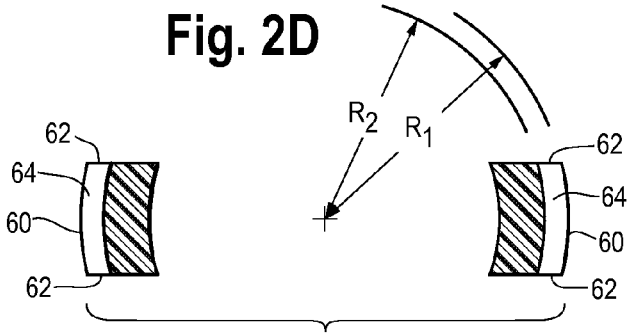
FIG. 2D is a cross sectional view of the locking ring of FIG. 2B taken along line 2D-2D.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, there is shown in FIGS. 1, 3, 4 and 6 one embodiment of the present invention, a child resistant container 10 made primarily of easily recyclable paper based materials. The container 10 comprises three components: a tubular body 12, a cap 14 that can be removeably secured to the body 12, and a locking ring 16 that fits inside the cap.

The body 12 comprises a bottom wall 18 and a side wall 20 extending circumferentially upward from the bottom wall 18 and terminating in a top rim 22. The side wall 20 may be cylindrical, and preferably has a circular cross section. The bottom wall 18 may be a stiff paper disc fitted within an internal groove near the bottom of the container side wall 20. The side wall 20 below the bottom wall 18 may be curled inward against the inside surface of the container body 12 and can be glued thereto to help hold the bottom wall 18 in place. The illustrated body 12 has a circular cross section and is somewhat elongated, which gives it a vial shape. However, the body 12 can be any suitable shape.

At least one and preferably two openings 24 are disposed in the body side wall 20. In the preferred embodiment there are two diametrically opposed openings 24 located near the top rim 22. Each opening 24 is substantially rectangular, although the openings may be any suitable shape, including round. The openings 24 may be cut into the side wall 20 at a ninety degree angle to the side wall ("square with the side wall") so that the sides of the openings 24 are perpendicular to the outer and inner surfaces of the side wall 24.

The cap 14 comprises a top wall 26 and a side wall 28 extending circumferentially downward from the top wall 26 and terminating in a bottom rim 30. The cap side wall 28 should be shaped so that the cap 14 fits snugly over the body 12 in telescoping fashion. Like the container bottom wall 18, the top wall 26 may be a stiff paper disc fitted within an internal groove near the top of the cap side wall 28. The side wall 28 above the top wall 26 may be curled inward against the inside surface of the cap 14 and can be glued thereto to help hold the top wall 26 in place.

At least one and preferably two openings 32 are disposed in the cap side wall 28. In the preferred embodiment there are two diametrically opposed openings 32 located in the cap side wall 28 so that the cap openings 32 can be aligned with the body openings 24. Each cap opening 32 is substantially rectangular, although the cap openings 32 may be any suitable shape, including round.

FIGS. 2A, 2B, 2C and 2D are various views of the locking ring 16. The locking ring 16 is a separate component and comprises a resilient, semi-circular body 36 having one or more squeeze tabs 38 extending radially outward from the body 36. In the preferred embodiment there are two squeeze tabs 38 located on diametrically opposite sides of the body 36. The squeeze tabs 38 are configured to engage (fit within) the openings 32 in the cap 14.

The semi-circular body 36 has a height defined as the distance between its upper rim 40 and its lower rim 42. The arc of the body 36, defined as the continuous portion of the body 36 from the outer tip 44 of one free end 46 to the outer tip 48 of other free end 50, is greater than 180 degrees and preferably greater than 270 degrees.

Figure 6:
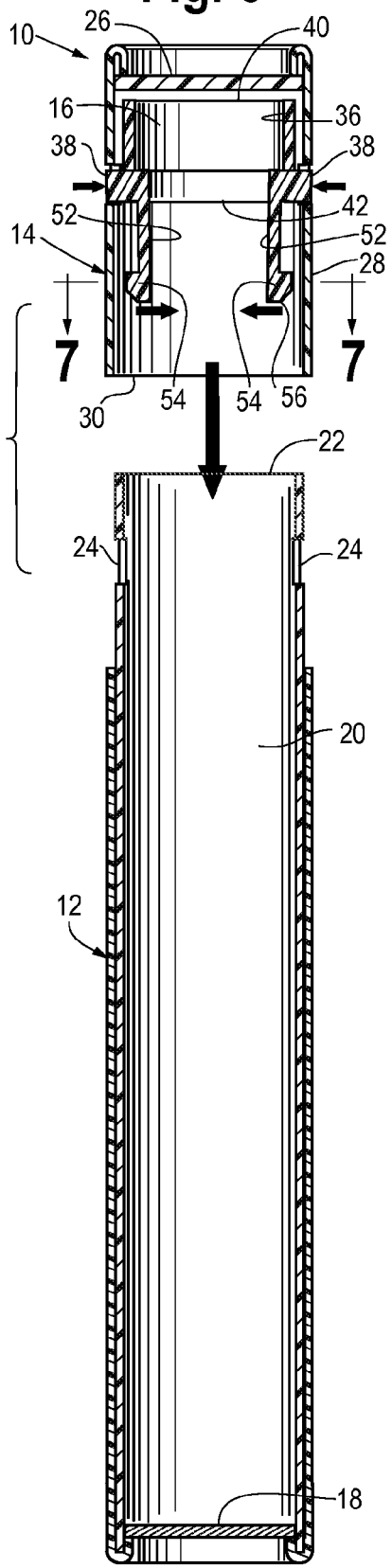
FIG. 6 is a cross sectional view of a container according to the present invention shown just prior to the cap being fitted onto the container body.

Still referring to FIGS. 2A through 2D, a segment or arm 52 extends axially (vertically) downward from the locking ring body 36 below each squeeze tab 38. A locking detent 54 extends radially outward from each arm 52, preferably at or near the distal (lower) end 56 of each arm 52. The locking detents 54 are configured to engage (fit within or extend through) the openings 24 in the container body 12. Thus the vertical distance between the squeeze tabs 38 and the locking detents 54 is the same as the distance between the openings 32 in the cap 14 and the openings 24 in the container body 12 when the cap 14 is locked onto the body 12. As best shown in FIG. 6, the length of each arm 52 is such that the arms 52 do not extend below the lower rim 30 of the cap 14.

In the illustrated embodiment each locking detent 54 comprises a tapered or angled lower wall 58 that joins a horizontally curved outer facing wall 60, parallel side walls 62 and a top wall or ledge 64. The side walls 62 are flat (planar) and thus substantially parallel to the sides of the body openings 24 when the cap 14 is locked onto the body 12. Alternatively, the detent side walls 62 may be beveled to facilitate disengagement of the locking detents 54 from the body openings 24 and thus removal of the cap 14 from the body 12, although this configuration is not recommended for child proof medicine containers.

In the locking ring's unstressed state (i.e., when the cap 14 is removed from the container body 12), the radius defined by the outwardly facing walls 60 of the locking detents 54 ($R_1$ in FIG. 2D) exceeds the inner radius of the container body 12 ($R_2$) (but not the outer radius of the upper portion 70 of the container body 12, which is greater than or substantially the same as $R_1$). Thus inserting the cap 14 onto the container body 14 is made easier by squeezing the squeeze tabs 38 and drawing the locking detents inward as shown in FIG. 6. The tapered lower wall 58 on each locking detent 54 facilitates insertion of the cap 14 onto the body 12.

Figure 3:
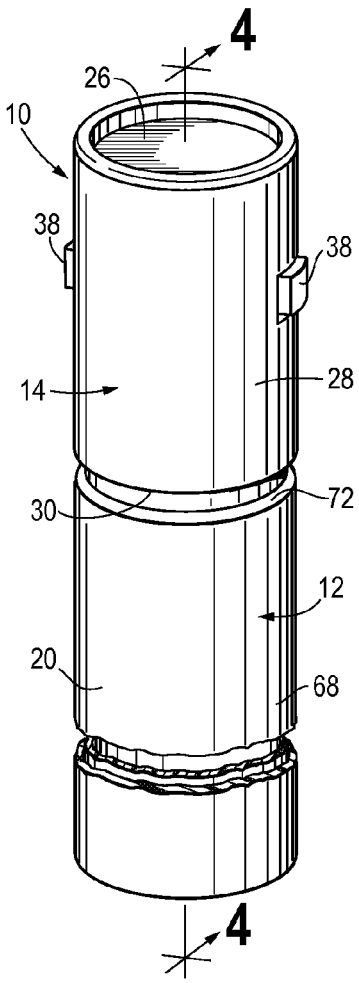
FIG. 3 is a perspective view of a container according to the present invention shown in the closed mode.
Figure 4:
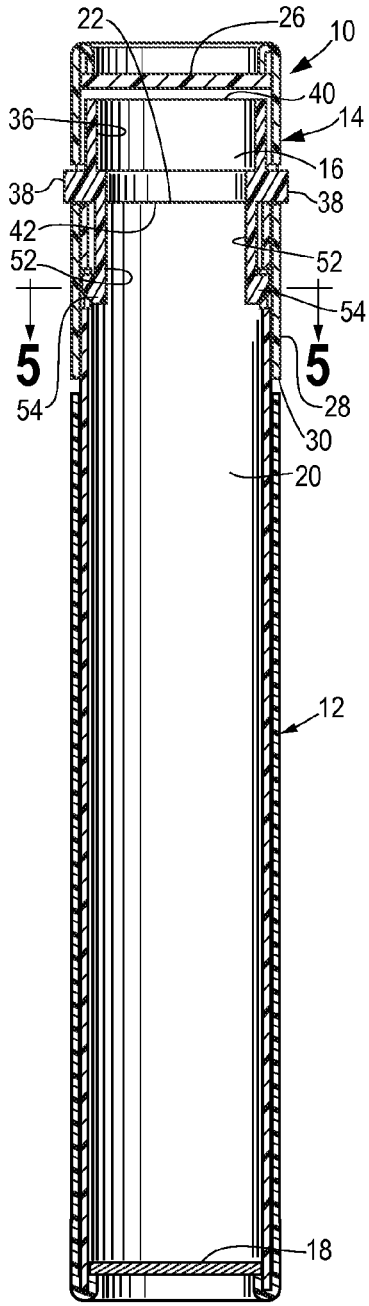
FIG. 4 is a cross sectional view of the container of FIG. 3 taken along line 4-4.
Figure 5:
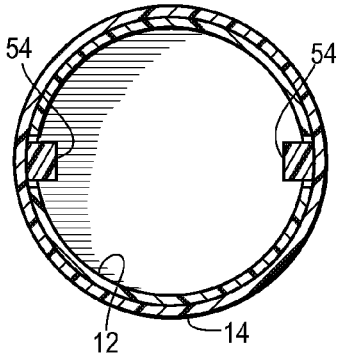
FIG. 5 is a cross sectional view of the container of FIG. 4 taken along line 5-5, showing the locking detents engaging the openings in the container body.
Figure 7:
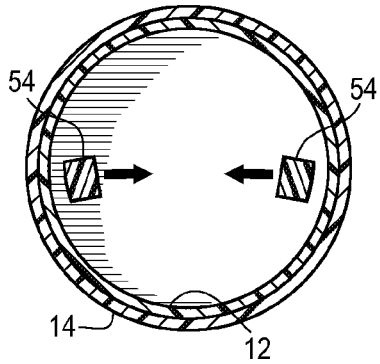
FIG. 7 is a cross sectional view of the container of FIG. 6 taken along line 7-7, showing the locking detents not yet engaging the openings in the container body.

The plastic locking ring 16 is secured to the cap 14 by the squeeze tabs 38 as shown in FIGS. 3 and 4. When the cap 14 is locked onto the container body 12 the plastic locking ring 16 biases the locking detents 54 outward and in locking engagement with the openings 24 in the container body 12, as best shown in FIGS. 4 and 5. Squeezing the squeeze tabs 38 together slightly distorts the locking ring body 36 and causes the locking detents 54 to move inward as shown in FIGS. 6 and 7.

In summary, the locking ring 16 acts as spring-like mechanism to lock the cap 14 onto the container body 12. The shape, dimensions and even material of construction of the locking ring 16 may be varied to provide the desired amount of pressure (squeezing force) required to open the container 10.

In the illustrated embodiment the container body 12 comprises a lower portion 68 and an upper portion 70 having the same inner diameter but different outer diameters, the upper portion 68 outer diameter being slightly smaller, resulting in a container body 12 having a circumferential ledge or abutment 72 intermediate the bottom wall 18 and the top rim 22. The cap 14 has an inner diameter is substantially the same as the outer diameter of the body upper portion 70 and an outer diameter substantially the same as the outer diameter of the body lower portion 68. As shown in FIGS. 3 and 4, when the cap 14 is locked onto the container body 12, the outer diameter of the container 10 is the same as the outer diameter of the cap 14 and body lower portion 68 except in the area where the body upper portion 70 is exposed between the cap 14 and the ledge 72. Alternatively, the cap side wall 28 can be extended further downward and/or the lower body portion 68 can be extended further upward so that the cap bottom rim 30 abuts the ledge 72, thereby providing a container 10 with a continuous smooth surface and a constant outer diameter.

Preferably the container body 12 and cap 14 are both made from fiber materials such as spirally wound paper, and the locking ring 16 is made from resilient plastic. For example, as is well known in the art, the container body 12 and cap 14 may comprise a fiber based structural layer and a high-barrier inner liner to provide a container having oxygen and moisture barrier properties. A label may be applied to the outer surface of the structural layer. An optional shrink band or outer seal (not shown) may be applied over the annular area where the cap 14 and body 12 meet as an additional barrier and/or for product security (as a tamper evident device).

The high barrier inner liner (not shown in the Figures) can cover the inside of the container up to the body openings 24, up to the cap-body interface, or even up inside the cap to completely seal the container, including covering both the openings 32 in the cap 14 and the openings 24 in the container body 12. There are at least two possible ways to achieve this "complete inner seal" configuration. In one ("aligned") embodiment the squeeze tabs 38 are aligned with the openings in the cap and the locking detents 54 are aligned with the openings in the body, but the inner liner is strong enough to prevent both the squeeze tabs 38 and the locking detents 54 from extending into the respective openings 32, 24. To open a container having such an inner liner and an outer shrink band, the user must first peel away the shrink band that seals the outer side of the cap-body interface. The user can then remove the cap 14 while breaking the inner seal provided by the inner liner. Finally, the user can use a finger to push the squeeze tabs 38 through the cap openings 32, thereby breaking the inner liner where it covers the openings 32. The user can also break the inner liner where it covers the openings 24 in the container body 12 so that the locking detents 54 can engage the body openings 24 when the cap 14 is re-positioned on the container body 12.

In another ("unaligned") embodiment the locking ring 16 is oriented within the cap 14 so that the squeeze tabs 38 are not aligned with the cap openings 32 and the locking detents 54 are not aligned with the openings 24 in the container body 12. After the outer shrink band is peeled away and the cap 14 is removed from the body 12 the locking ring 16 can be manually pushed or rotated until the squeeze tabs 38 align with and snap into the cap openings 32 while simultaneously breaking through the inner liner. If necessary, the user can manually break the inner liner where it covers the openings 24 in the container body 12. In either embodiment, the container 10 now has continued child resistance.

Thus the present invention provides an all fiber, or mostly fiber, easy to recycle alternative to the conventional child proof packages known in the art that consist primarily of plastic and can be too difficult to open. Even if the locking ring 16 is made of plastic, it can be recycled separately from the fiber components.

The invention works in the following manner. To secure the cap 14 to the body 12 the user simultaneously squeezes (pushes in) the squeeze tabs 38 while sliding the cap 14 over the body 14 until the lower rim 42 of the locking ring 16 abuts the top rim 22 of the container body 12. If necessary, the cap 14 can be rotated until the locking detents 54 are aligned with the body openings 24 for engagement therewith to lock the cap 14 onto the body 12. When the cap 14 is locked onto the body 14 their respective openings 32, 24 are vertically aligned. Because the cap sidewall 28 extends below the locking detents 54, the locking detents 54 cannot be seen when the container 10 is closed (see, for example, FIG. 3).

Figure 8:
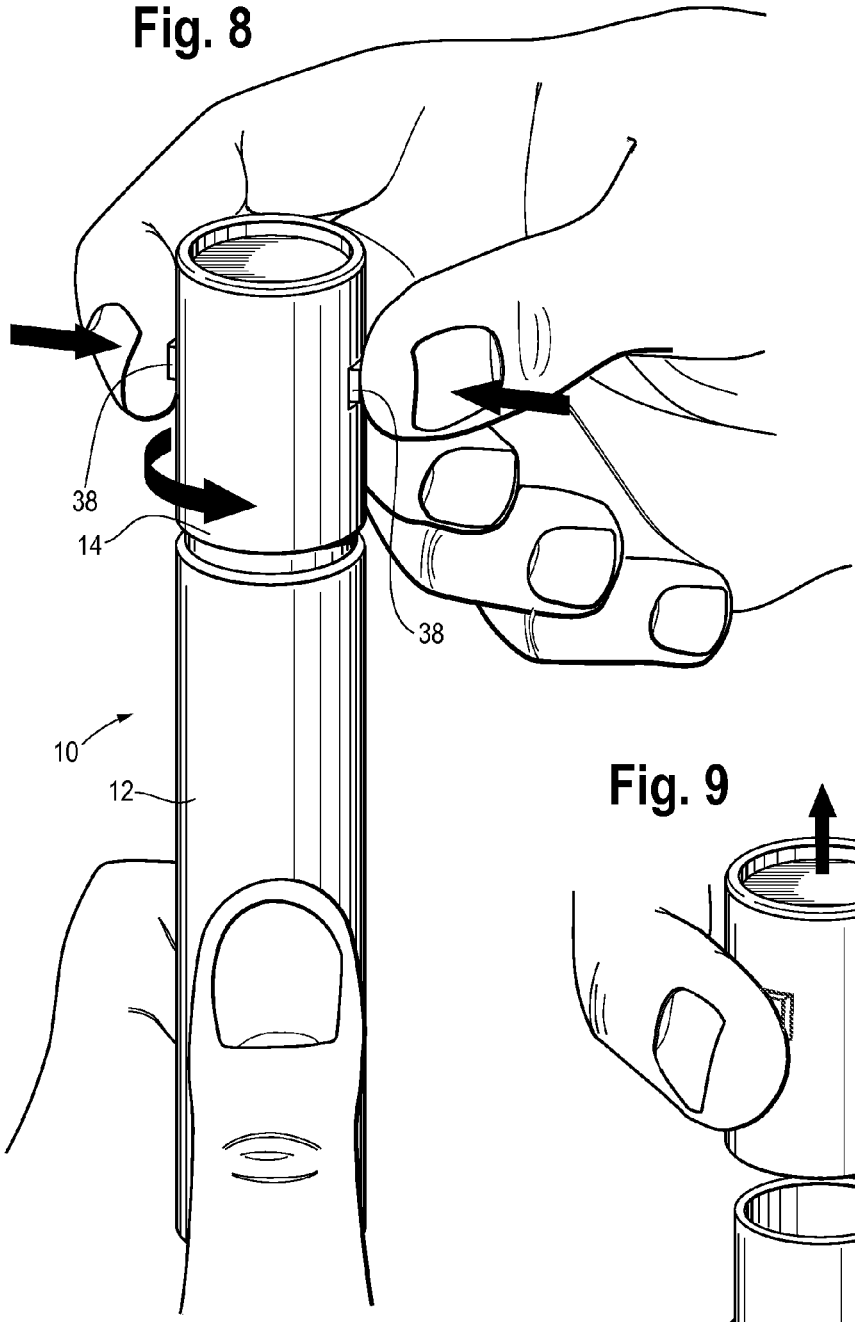
FIG. 8 is a perspective view of a locked container just prior to being opened, showing the user movements necessary to open the container.
Figure 9:
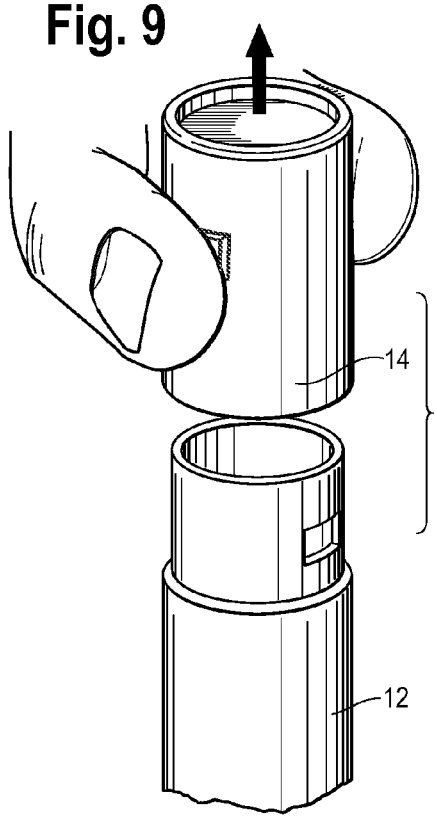
FIG. 9 is a partial perspective view of the container of FIG. 8 after being opened.

Referring to FIGS. 8 and 9, to open the container 10 the user again squeezes (pushes radially inward) the squeeze tabs 38, thereby disengaging the locking detents 54 from the container body openings 24, while simultaneously lifting upward on the cap 14. Optionally, the user can rotate the cap 14 with respect to the body 12 while lifting to facilitate removal of the cap 14.

While it is preferred that the locking ring 16 be located inside the cap 14, it is also possible to place the locking ring 16 inside the container body 12 with the locking ring arms 52 extending upwards. Also, multiple locking rings could be used inside a single container.

It should be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. A child proof container having an open position and a closed position, the child proof container comprising:

a tubular body having a bottom wall, a side wall extending circumferentially upward from the bottom wall and terminating at a top rim, an open top end, and a pair of diametrically opposed openings located in the tubular body side wall;

a cap having a top wall, a side wall extending circumferentially downward from the top wall and terminating at a bottom rim, an open bottom end configured to be slidably received by the tubular body top end, and a pair of diametrically opposed openings located in the cap side wall; and a locking ring comprising a resilient, semi-circular body having an upper rim and a lower rim, a pair of diametrically opposed squeeze tabs extending radially outward from the locking ring body and engageable with the openings in the cap whether the container is in the open or in the closed position, a pair of arms extending axially downward from the semi-circular body below each squeeze tab, respectively, and each arm terminating at a lower end, and a locking detent extending radially outward from the lower end of each arm and engageable with the tubular body openings to prevent the removal of the cap from the tubular body;

wherein when the container is in the closed position, the locking ring lower rim abuts the tubular body top rim and the locking ring body biases the locking detent of each locking ring arm outward through the tubular body openings; and wherein inward radial movement of the squeeze tabs causes the locking detent of each locking ring arm to disengage from the tubular body openings, thereby allowing the cap to be removed from the tubular body.

2. The child proof container of claim 1 wherein each locking detent comprises an upwardly tapered curved bottom wall that joins a curved outwardly facing wall, parallel side walls and a ledge, and wherein the locking detent side walls are flat.

3. The child proof container of claim 1 wherein each locking detent comprises a tapered lower wall that joins a curved outer facing wall, parallel side walls and a ledge, and wherein the locking detent side walls are beveled to facilitate disengagement of the locking detents from the body openings.

4. The child proof container of claim 1 wherein the semi-circular body defines an arc greater than 180 degrees.

5. The child proof container of claim 4 wherein the semi-circular body defines an arc greater than 270 degrees.

6. The child proof container of claim 1 wherein the container tubular body and cap are both made from fiber materials and the locking ring is made from resilient plastic.

7. The child proof container of claim 6 wherein the container tubular body and cap are made from spirally wound paper.

* * * * *